US006357623B1

(12) United States Patent
Biehl et al.

(10) Patent No.: US 6,357,623 B1
(45) Date of Patent: Mar. 19, 2002

(54) METHOD AND APPARATUS FOR UNMATCHING AND MAKING AVAILABLE FOLDED CARDBOARD BOXES

(75) Inventors: Johann Biehl, Holte-Stukenbrock; Michael Damps, Rheda-Wiedenbrueck, both of (DE)

(73) Assignee: Klockner Hansel GmbH, Hannover (DE)

( * ) Notice: Subject to any disclaimer, the term of this patent is extended or adjusted under 35 U.S.C. 154(b) by 0 days.

(21) Appl. No.: 09/562,415

(22) Filed: May 1, 2000

(30) Foreign Application Priority Data

May 3, 1999 (DE) ..... 199 20 072

(51) Int. Cl.[7] ..... B23Q 7/04
(52) U.S. Cl. ..... 221/210; 221/278
(58) Field of Search ..... 221/210, 211, 221/212, 213, 226, 232, 238, 258, 268, 278

(56) References Cited

FOREIGN PATENT DOCUMENTS

| | | |
|---|---|---|
| AU | B236 | 11/1919 |
| DE | 236875 | 11/1964 |
| DE | 29 23 909 | 12/1980 |
| DE | 29 23 909 A | 12/1980 |
| DE | 37 22 285 A | 1/1989 |
| DE | 89 14 860 | 3/1990 |
| DE | 89 14 860.6 | 5/1990 |
| DE | 44 30 701 A1 | 3/1996 |
| DE | 199 18 476 A | 10/2000 |

OTHER PUBLICATIONS

Prospectus—Uhlmann Pac–Systeme GmbH & Co. KG, 1995.

Prospectus—CUK/CTK Robert Bosch GmbH, 10.92.

*Primary Examiner*—Kenneth W. Noland
(74) *Attorney, Agent, or Firm*—Thomas, Kayden, Horstemeyer & Risley LLP

(57) ABSTRACT

A stack of folded cardboard boxes (5, 6) is arranged in a magazine (1). Each folded cardboard box (5, 6) has a plane of main extension (7) and two parallel side edges (9, 10). The folded cardboard boxes (5, 6) arrive in the stack in a direction substantially perpendicular to the plane of main extension (7). The two parallel side edges (9, 10) of the first folded cardboard box (5) in the stack are first contacted and supported by a first stop (11) and by a second stop (12). The first folded cardboard box (5) is then conveyed in the direction toward the second stop (12) within the plane of main extension (7) until it enters an opening (18) being located in the region of the second stop (12) and it gets totally free from contact to the first stop (11) to be exclusively supported by the opening (18) and by the second stop (12). Due to gravity of the folded cardboard boxes (5, 6), the first folded cardboard box (5) only being supported at one of its two side edges with its other side edge bends in a direction away from the stack. Afterwards, the first folded cardboard box (5) is removed from the stack.

10 Claims, 2 Drawing Sheets

METHOD AND APPARATUS FOR UNMATCHING AND MAKING AVAILABLE FOLDED CARDBOARD BOXES

CROSS REFERENCE TO RELATED APPLICATIONS

This application claims the benefit of co-pending German Patent Application No. 199 20 072.6-27 entitled "Verfahren und Vorrichtung zur Vereinzelung und Bereitstellung von Faltschachtelzuschnitten" filed on May 3, 1999.

FIELD OF THE INVENTION

The present invention generally relates to a method of unmatching and making available folded cardboard boxes. More particularly, the present invention relates to a method of unmatching and making available folded cardboard boxes in which the cardboard boxes are arranged in a stack in a magazine, and each first cardboard box is removed from the stack. Unmatching is to be understood as the process of separating one single item from a plurality of items. The present invention also relates to an apparatus for unmatching and making available folded cardboard boxes. The present invention is especially applicable in combination with folded cardboard boxes which have to be unmatched and brought into an upright position to feed a carton apparatus. Nevertheless, the present invention may not only be used to unmatch folded cardboard boxes, but also different flat items.

BACKGROUND OF THE INVENTION

Usually, folded cardboard boxes are delivered to the user as glued and folded flat cartons. The folded boxes are put on a conveyor belt in stacks, or they are inserted into a magazine or on a conveying path being prearranged with respect to the magazine. The magazine often has a downwardly directed end portion including two stops engaging parallel sides of the folded cardboard boxes, and preventing the stack of folded cardboard boxes from falling down out of the magazine due to gravity or a conveying pressure. The stops may have the design of retaining carriers or a different design. The stops are stationary during production. The stops may be designed and arranged to be adjustable, but the distance between the stops remains unchanged during the unmatching process of the cardboard boxes.

An apparatus for unmatching and making available folded cardboard boxes in combination with a carton apparatus is known from a prospectus of Uhlmann Pac-Systeme GmbH & Co. KG, Laupheim/Germany (printed in Germany 1995; d 700) and from the prospectus "CUK/CTK" of Robert Bosch GmbH (printed VM/VEK 1, 10.92). The magazine containing the folded cardboard boxes ends in a downwardly directed portion ending in first and second stops. Two first and two second stops engage both outer side edges of the folded cardboard boxes to better guide and hold the folded cardboard boxes. The stops protrude in a forward direction to a certain extent, and they are arranged in a spaced apart manner such that the stack of cardboard boxes is supported by the stops against the conveying pressure and/or gravity. The folded cardboard boxes are conveyed into the stack in a direction approximately perpendicular to their plane of main extension. An apparatus for removing the first cardboard box from the stack is arranged in the region of the stops. The apparatus includes a rotor including arms. Suction devices are arranged at the free ends of the arms, the suction devices being subjected to negative pressure. The suction devices engage one of the two side walls of the first folded cardboard box being arranged in the magazine and being supported by the stops. Since the folded cardboard boxes have a folded, flat, usually parallelogram-like cross section, it is possible to engage one of the free side surfaces of the first cardboard box by the suction device. The cardboard box is slightly bent during the removal procedure such that its effective length between the two stops is slightly decreased, and the first cardboard box may be removed from between the two fixed stops. The suction devices pull the first cardboard box out of the stack. The following folded cardboard boxes remain supported by the stops in the magazine. The cardboard box being grasped by the suction devices are opened, and they are inserted into a clocked conveying chain in an upright position in a way that the upright cardboard box may be filled with items.

The operational reliability of such known apparatuses is limited. The operational reliability depends on numerous factors. For example, different tolerances of the folded cardboard boxes have a negative effect. The stiffness and the quality of the carton material from which the folded cardboard boxes are made also has an influence on the processibility. Additionally, humidity during storing and unmatching of the folded cardboard boxes may have a negative effect on the reliability of the apparatus for unmatching the cardboard boxes. There are also other influencing variables known to one with skill in the art. It has already been tried to design and arrange the stops to be adjustable with respect to one another to be capable of taking different conditions into account. The respective adjustment of the stops has to be done in a sensitive manner to prevent a plurality of cardboard boxes from leaving the end of the magazine at the same time, and to ensure that the first cardboard box is singled out and removed from the stack. When changes occur during the operation, there is the danger of the apparatus not working correctly, and it will be necessary to newly adjust the stops. Even the intensity with which the folding lines are realized at the folded cardboard box may have a negative effect on the unmatching operation of the stack of folded cardboard boxes.

The apparatuses for unmatching and making available of folded cardboard boxes as described in the above mentioned prospectuses are prearranged to a carton erecting device. The carton erecting device includes a rotor including arms. Suction devices are arranged at the ends of the arms. The rotor and the arm, respectively, is guided along a cycloid. Except at the ending of the movement, the cycloid always has a component of movement being directed perpendicular to the plane of main extension of the folded cardboard boxes in the stack and a component being directed in the direction of the plane of main extension of the folded cardboard boxes. The latter component of movement disturbs the pulling action of each first folded cardboard box in the magazine.

SUMMARY OF THE INVENTION

Briefly described, the present invention provides a method of unmatching and making available folded cardboard boxes. A stack of folded cardboard boxes is arranged in a magazine. Each folded cardboard box has a plane of main extension and two parallel side edges. The folded cardboard boxes arrive in the stack in a direction substantially perpendicular to the plane of main extension. The two parallel side edges of the first folded cardboard box in the stack is contacted and supported by a first and by a second stop. The first folded cardboard box is conveyed from the first stop in the direction toward the second stop within the plane of main extension until it enters an opening being located in the region of the second stop and it gets totally free from contact to the first stop to be exclusively supported by the opening and by the second stop. Due to gravity of the folded cardboard boxes, the first folded cardboard box only being supported at one of its two side edges with its other side edge bends in a direction away from the stack. Afterwards, the first folded cardboard box is removed from the stack.

The present invention also provides an apparatus for unmatching and making available folded cardboard boxes. The apparatus includes a magazine including a first stop, a second stop and an opening being arranged in the region of said second stop. The magazine is designed and arranged to hold a stack of folded cardboard boxes. The folded cardboard boxes each have a plane of main extension and two parallel side edges. The folded cardboard boxes arrive in the stack one after the other in a direction substantially perpendicular to the plane of main extension. The first and the second stop each are designed and arranged to contact and to support the two parallel side edges of the first folded cardboard box in the stack. A conveying apparatus serves to convey the first folded cardboard box from the first stop in the direction toward the second stop within the plane of main extension until the first folded cardboard box enters the opening being arranged in the region of the second stop and it gets free from contact to the first stop to be exclusively supported by the opening and by the second stop. The first folded cardboard box bends in a direction away from the stack due to gravity of the folded cardboard boxes. An apparatus serves to remove the first folded cardboard box from the stack.

The present invention is based on the concept to first move and convey the first folded cardboard box along a comparatively short distance, and then to totally free the first folded cardboard box from contact to the first stop at its one side edge, and to support it at its other side edge. The first folded cardboard box is to be understood as the cardboard box being located in the stack for the longest period of time. In other words, the first box is the box which is first as seen in the conveying direction of the boxes entering the magazine. The following folded cardboard boxes remain supported by the two stops after a small turning motion. The small lateral displacement of the first folded cardboard box during its insertion into the opening provides the advantage of the first folded cardboard box only being supported at one side. Consequently, it only has to be removed from one stop. It is no longer necessary to attain a shortening between the two parallel side edges of the closed folded cardboard box during the removing procedure. Instead, it is possible to remove the folded cardboard box being supported at one side edge with a component of movement being located in the plane of main extension of the first cardboard box right at the beginning of the movement. Thus, the novel method and apparatus for unmatching folded cardboard boxes may especially be used in combination with carton apparatuses including a rotating removing apparatus with turning arms and suction devices.

The novel method provides a number of advantages. Due to the removal of the first cardboard box in a position in which it is only supported at one of its sides, it is not necessary to sensitively adjust the first stop with respect to the second stop. The distance between these two stops is only important as the distance has to be small enough to still securely support the following cardboard boxes in the stack. Consequently, the period of time for changing the adjustment of the apparatus is reduced in case of a change of the format and size of the cardboard boxes to be processed. The walls of the magazine, on the one hand, and the stops, on the other hand, do not have to be adjusted any more. Even more importantly, the novel apparatus is much less sensitive with respect to changes of the pressure of the cardboard boxes contacting each other in the magazine. The following conveying action is simplified. There is no need for an additional sensor. Substantial changes of the pressure are easy to withstand. The novel method is easily applicable to folded cardboard boxes having a square cross section. In case there are tolerances in the dimensions of the folded cardboard boxes, as this is not totally preventable with different charges, there is no need to newly adjust the stops.

It makes sense if the first cardboard box is removed rotationally with a component of movement being directed in a direction opposite to its conveying direction. Many known removing apparatuses work in a way such that there is only one component of movement perpendicular to the direction of main extension of the first folded cardboard box at the beginning of the movement. In the following, there is an additional component of movement being directed in a transverse direction. The novel method is not limited to such removing apparatuses. In the contrary, it is possible to use very simple rotors to take and make available the first cardboard box. At the beginning of the movement, there may be a component of movement to pull the folded cardboard box being supported at one of its sides out of the opening.

There is a great number of possibilities to one with skill in the art to realize the transverse movement of the first folded cardboard box being supported at one of its sides. It is possible to use the first stop to convey the first folded cardboard box in a transverse direction by moving the first stop back and forth in the plane of main extension. It is also possible to realize the transverse conveying action of the first folded cardboard box by a piston and cylinder unit being subject to pneumatic pressure. A third possibility uses rotating pressure brushes that contact the free surface of the first cardboard box for a limited period of time to overcome the friction between the first folded cardboard box and the following folded cardboard box, and to realize the transverse movement of the first folded cardboard box with respect to the following folded cardboard boxes.

The transverse conveying apparatus only engaging the first folded cardboard box and only having an effect on the first folded cardboard box, respectively, is important to the novel apparatus. The distance along which the first folded cardboard box is conveyed in a transverse direction is only a small percentage of the distance between the two stops. It is sufficient to chose a transverse conveying distance ensuring that the first folded cardboard box is totally freed at one of its sides, and it is exclusively supported on its other side, while the free first stop still fulfils its function to support the following folded cardboard boxes in the stack. Due to the fact that the first folded cardboard box being moved in a transverse direction does not contact the first stop any more, the first folded cardboard box with its free side does not contact the following folded cardboard boxes any more. The first folded cardboard box is bent in a direction away from the stack. This position is advantageous to remove the first folded cardboard box. It is especially ensured that the two side walls of the first folded cardboard box facing away from the suction device of the removing apparatus may be directed in an outward direction as desired. Similar is true to the suction device at the two other side surfaces.

With the novel apparatus, it is not necessary to sensitively adjust the stops. It is also not necessary to check the position of the stops, and to readjust the stops. Tolerances due to different charges of cardboard boxes may be processed by the apparatus without the necessity of the chosen adjustment being changed. Thus, there is the possibility to save the adjustment conditions for each format in a way that these conditions may be reused later. Consequently, the period of time for readjusting the apparatus in case of a change of the format or the dimensions of the folded cardboard boxes is decreased, and the novel apparatus depends less on negative influences, especially on a change of the pressure being supplied by gravity or a device for conveying the folded cardboard boxes in the conveying direction.

The conveying apparatus may be a lifting drive being connected to the first stop. Such a lifting drive having the effect of the first stop moving back and forth has an especially simple design. For example, the lifting drive may use an eccentric drive or a cam drive. The necessary stroke of the lifting drive is comparatively low, and it may have a value of a few millimeters. A lifting drive makes it possible to attain great unmatching velocities.

The first stop includes a step for the exclusive connection to the first folded cardboard box. The step is an additional feature of the first stop. The step works in a different plane than the the stop. The step moves together with the stop such that the first folded cardboard box is freed from the first stop when the transverse conveying action is finished and when the first folded cardboard box has entered the opening. The first folded cardboard box is freed at the side of the first stop when the stop finishes its backward stroke.

It is advantageous if the step for engaging the first folded cardboard box includes an undercut. Such an undercut makes sure that only the first folded cardboard box is conveyed in a transverse direction. The step including an undercut engages the free side edge of the folded first cardboard box. The pressure prevailing in the stack is used to securely engage the first folded cardboard box. It is important to securely engage the first folded cardboard box to realize great working velocities of the apparatus.

Additionally, the distance between the first and the second stop may be designed and arranged to be adjustable. The adjustability allows for a change of the dimensions of the cardboard boxes. At the same time, the distance between the first stops and the second stops is adjusted to certain values. It is not necessary to sensitively adjust the stops with respect to one another. Nevertheless, it makes sense to design and arrange the first and the second stop to be adjustable to the thickness of the folded cardboard boxes. An adjustability in this direction is not necessary in many cases, for example if usual carton having a defined weight is used, as this is generally known for strip packings for drugs. In case strongly varying thickness of cartons are processed with one and the same apparatus for unmatching cardboard boxes, it makes sense to design and arrange the stops to be adjustable.

In many cases, the depth of the opening in the direction of the transverse movement is identical to or greater than the stroke of the first stop.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
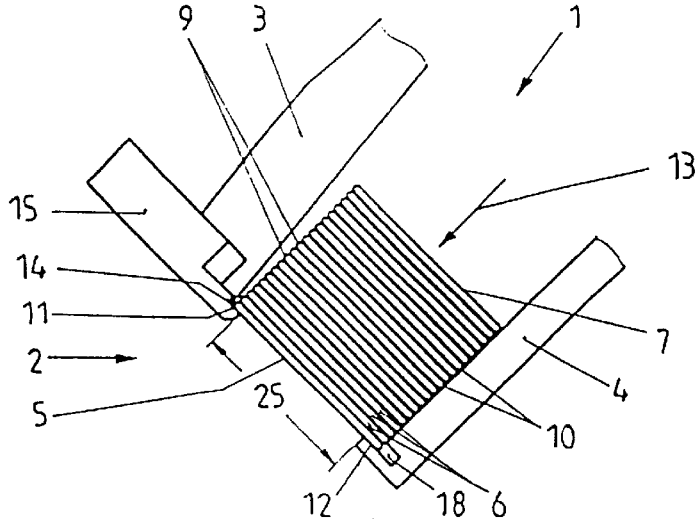
FIG. 1 is a schematic side view of the essential elements of the apparatus for unmatching and making available folded cardboard boxes in its starting position.
Figure 4:
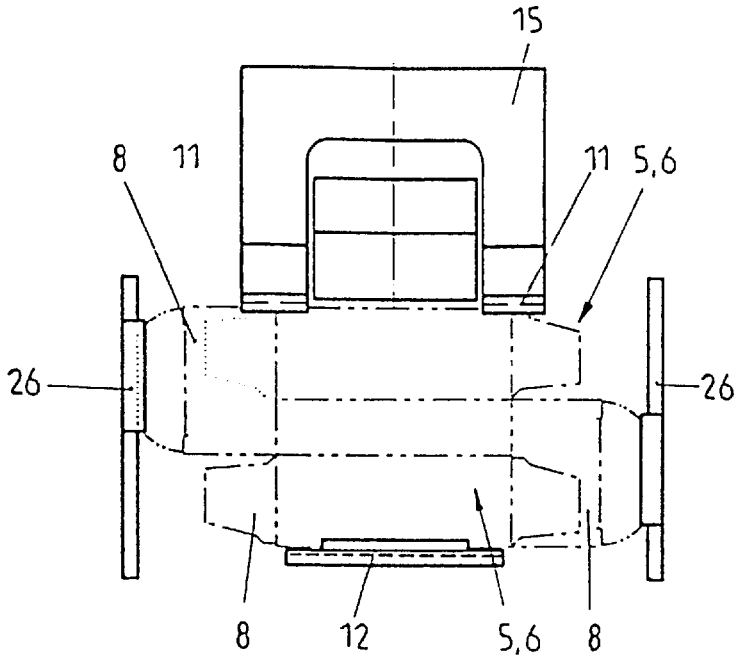
FIG. 4 is a schematic front view of the elements according to FIG. 1.

Referring now in greater detail to the drawings, FIG. 1 schematically illustrates a magazine 1 having a downwardly inclined end portion 2. The magazine 1 includes side walls 3 and 4. The side walls 3 and 4 may be guiding bars, guiding angles or the like. A stack of folded cardboard boxes is located between the side walls 3 and 4. In the following, the first folded cardboard box is designated by reference numeral 5 and the following cardboard boxes are designated by reference numeral 6. The folded cardboard boxes 5 and 6 with their surfaces in their plane of main extension 7 contact each other. FIG. 1 only illustrates a limited number of folded cardboard boxes 5 and 6. Nevertheless, there usually is a greater number of folded cardboard boxes 6 being arranged one behind the other in the stack. It is especially possible that the side walls 3 and 4 forming the feed track for the magazine 1 have a correspondingly long design. It is possible that the magazine 1 has a comparatively long horizontal portion being connected to a slightly downwardly inclined end portion 2. The folded cardboard boxes 5 and 6 are made of carton having corresponding side walls. Usually, the cardboard boxes have a rectangular parallelogram-like flat design in which two side walls of the folded cardboard boxes 5 and 6 contact each other. It is to be understood that such a folded cardboard box as illustrated in FIG. 4 by the dash dotted line includes side flaps and bottom flaps 8 serving to close the folded cardboard boxes 5, 6 after the folded cardboard box 5, 6 has been erected and after the product to be packed has been inserted into the upright cardboard boxes 5, 6. The flat folded cardboard boxes 5, 6 as delivered to the user by the producer of the cartons have a closed, flat and folded design, the extension of the folded cardboard boxes 5, 6 in the plane of illustration of FIG. 1 being determined by the distance between two parallel side edges 9 and 10.

The stack of folded cardboard boxes 5, 6 being located in the magazine 1 is held and supported by a first stop 11 and by a second stop 12 engaging the two parallel side edges 9 and 10. The stops 11 and 12 slightly extend into the conveying cross section of the magazine 1 with respect to the side walls 3 and 4. Consequently, the stops 11 and 12 reduce the conveying cross section in the conveying direction according to arrow 13. The folded cardboard boxes 5 and 6 are conveyed and moved into the magazine 1 against the stops 11 and 12 according to arrow 13. The stack of folded cardboard boxes 5 and 6 subjects the stops 11 and 12 to a pressing force and to a pressing pressure, respectively, due to gravity and/or an additional conveying device.

A step 14 is located at the first step 11. The height of the step 14 in the direction of arrow 13 is coordinated with the thickness of a folded cardboard box 5, 6 such that the step 14 exclusively engages the first cardboard box 5. The first stop 11 and the step 14 may be arranged at a common stop carrier 15. The stop carrier 15 is driven according to arrow 16 (FIG. 2) and according to arrow 17 (FIG. 3), respectively, with respect to or together with the side wall 3 or a portion thereof in an alternate movement. The second stop 12 may be stationary. Consequently, it is not movable with respect to the side wall 4. An opening 18 is located in the region of the second stop 12 in the transverse conveying direction according to arrow 16. The opening 18 is designed and arranged in a way that the first cardboard box 5 may enter the opening 18 during its transverse movement, whereas the following folded cardboard boxes 6 are still supported by the side wall 4 to be stationary. In this way, it is possible to dislocate the first cardboard box 5 in a lateral direction with respect to the following cardboard boxes 6 by a transverse movement of the stop carrier 15, the stop 11 and the step 14.

Figure 2:
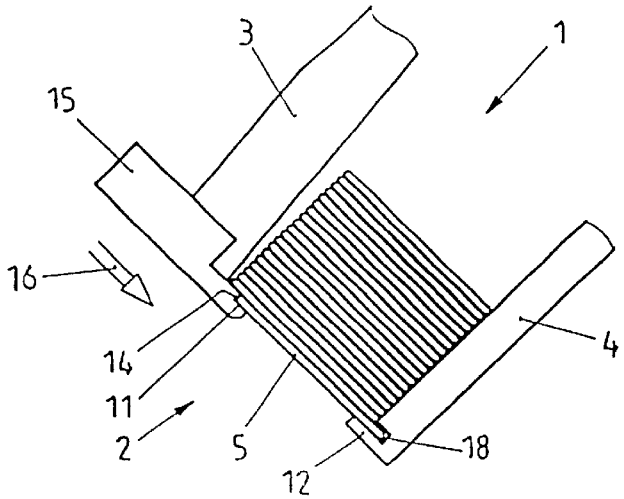
FIG. 2 is a side view similar to FIG. 1, but illustrating the position after the first folded cardboard box has been conveyed in a transverse direction.

FIG. 2 illustrates the end position of the stop carrier 15 being driven to move back and forth after the transverse conveying action is finished. It can be seen from FIG. 2 that the first cardboard box 5 is still supported by the two stops 11 and 12 although it already is laterally dislocated to a certain extent with respect to the stack of the following cardboard boxes 6. The dimensions of the opening 18 in the transverse conveying direction according to arrow 16 at least corresponds to the forward stroke of the stop carrier 15 together with the first stop 11 and the step 14.

During the transverse conveying action according to arrow 16 (FIG. 2), the first cardboard box 5 has to overcome the friction to the following cardboard box 6 in the plane of main extension 7. As soon as the stop carrier 15 is moved according to its backward stroke according to arrow 17, the pressure of the following cardboard boxes 6 and the friction with respect to the plane of main extension 7 of the first cardboard box 5, respectively, ensures that the first cardboard box 5 stays in position.

Figure 3:
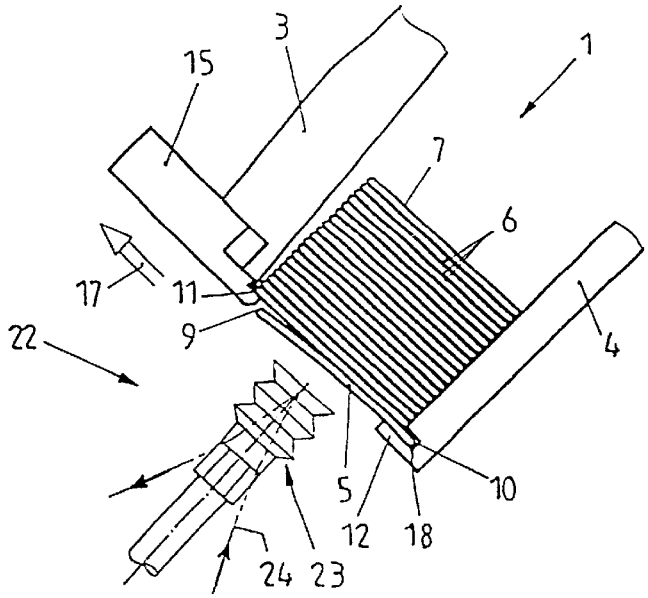
FIG. 3 is a similar view as FIGS. 1 and 2, but illustrating the position after the first folded cardboard box has been released at one of its sides.

The first cardboard box 5 is then located in a position as illustrated in FIG. 3. The first folded cardboard box 5 is only supported at one of its sides by the stop 12 and the opening 18, whereas its other side edge 9 freely protrudes without being supported. FIG. 3 also illustrates that the first folded cardboard box 5 slightly bends due to the fact that it is only supported at one of its sides. The deflection of the first cardboard box 5 is advantageous to the upcoming erection of the first cardboard box 5 in a way that the two side walls facing the following cardboard box 6 are opened about the corresponding folding line with the correct tendency. It is also to be seen from FIG. 3 that the stack of the following cardboard boxes 6 has a slightly transverse arrangement in this position. This arrangement does not have negative effects.

Figure 5:
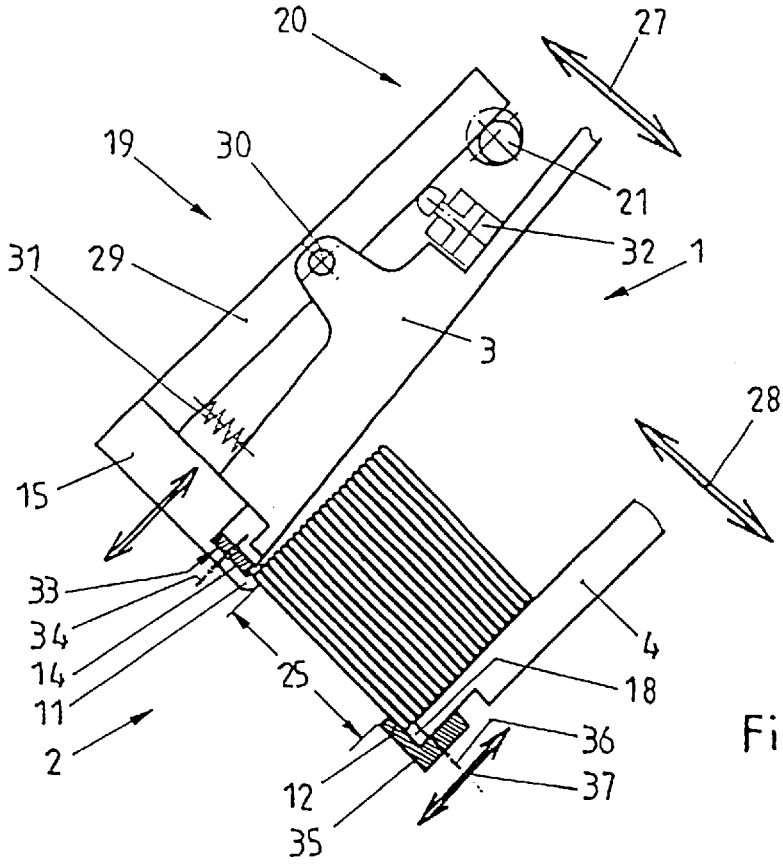
FIG. 5 is a more detailed view of the essential elements of the present invention.

FIG. 5 illustrates a transverse conveying apparatus 19 to effect the transverse conveying motion of the first cardboard box 5 in the direction of arrow 16. The transverse conveying apparatus 19 may include a lifting drive 20 including a can or an eccentric device 21. Nevertheless, it is also possible to use other transverse conveying apparatuses 19 and other drives, as they are generally known in the art.

FIG. 3 further schematically illustrates an apparatus 22 for the removal of the first folded cardboard box 5. The folded cardboard box 5 is removed from the stack as soon as it is only supported at the second stop 12. Usually, the apparatus 22 includes a rotor having arms. One or more suction devices may be arranged at the ends of the arms. The suction devices 23 are subjected to negative pressure. The arms and the suction devices 23, respectively, may be moved along a path of movement 24 being illustrated by a double dash dotted line and according to the arrows in FIG. 3. The path of movement 24 ends in a turning point at the free surface of the first cardboard box 5. The path of movement 24 an d the suction device 23 only include one component of movement in the turning point. The component of movement is directed perpendicular to the plane of main extension 7 of the first cardboard box 5. The path of movement 24 further makes it clear that, except in the turning point, there are components of movement having, an effect in the plane of main extension 7. The suction devices 23 may be arranged at one single arm or directly at one rotor, such that a correspondingly different path of movement 24 could occur. This path of movement 24 would have a substantial or an exclusive component of movement in the direction of arrow 17 also during the time when the first cardboard box 5 is removed from the stack. The first folded cardboard box 5 is pulled out of the opening 18, the movement being slightly inclined in a way that the free side edge 9 of the first folded cardboard box 5 may pass the first stop 11. The rotor of the apparatus 22 always removes the first folded cardboard box 5 from the stack in the magazine 1. The rotor further opens the cardboard box 5. The cardboard box 5 may then enter a clocked conveying apparatus in which the opened and upright cardboard box 5 is filled with the articles to be packed.

As soon as the first folded cardboard box 5 has been removed from its position as illustrated in FIG. 3, the stack of folded cardboard boxes 6 moves in a downward direction until the new first cardboard box 5 in the stack contacts the two stops 11 and 12. It is to be understood that the distance 25 between the stops 11 and 12 is less than the distance between the two side edges 9 and 10 of the cardboard boxes 5, 6. Preferably, the second stop 12 may protrude further into the free cross section of the magazine 1 between the side walls 3 and 4 than the first stop 11. This is illustrated in FIGS. 1 to 3. Usually, at least two first stops 11 are arranged on one side of the magazine 1 and at least two second stops 12 are arranged on the other side of the magazine 1 to support the cardboard boxes 5, 6, and to prevent them from being turned.

FIG. 4 illustrates a possible design of the stops 11 and 12. FIG. 4 also illustrates the design of a folded cardboard box 5, 6 with its bottom flaps 8. Stop bars 26 may be arranged on one side or on both sides. The stop bars 26 engage the longer bottom flaps 8, and they additionally support the bottom flaps 8 when the first cardboard box 5 is removed from the stack. The first folded cardboard box 5 is supported at four locations. Nevertheless, it is also possible to support the folded cardboard boxes 5 without the stop bars 26.

FIG. 5 illustrates the design of the front portion of the magazine 1 in greater detail. The side wall 3 is designed to be adjustable according to double arrow 27 to change the cross section of the magazine 1 and the relative position of the first stop 11, for example in case of a change of the dimensions of the cardboard boxes. The side wall 4 is designed to be adjustable in a similar way according to arrow 28. Consequently, the second stops 12 are also designed to be adjustable. In combination with the separate adjustment of the side walls 3 and 4 there is the possibility of adjusting the distance 25 between the two stops 11 and 12. The stop 11 and the stop carrier 15 may have a one piece design. The stop carrier 15 may be carried by a crank 29 being pivotally supported about a pivot bearing 30 and being operatively connected to the eccentric unit 21 of the lifting drive 20. A return spring 31 ensures the contact between the crank 29 and the eccentric unit 21, and it defines the return stroke according to arrow 17 (FIG. 3). Instead of the lifting drive including the eccentric unit 21, there may be a pneumatically actuated piston and cylinder unit 32 forming a substantial portion of the transverse conveying device 19. Nevertheless, there is a majority of different embodiments known in the art. The pneumatically actuated piston cylinder unit 32 may also be used in combination with the lifting drive 20 including the eccentric unit 21 as a locking device to stop the lifting drive 20. Consequently, it serves to turn the lifting drive 20 on an off.

FIG. 5 further illustrates a design in which the step 14 is formed by a plate 33 being adjustable to the thickness of the folded cardboard boxes 5, 6 by an adjustment screw 34 being schematically illustrated by its surface line. Similar is true to the second stop 12. In this arrangement, the second stop 12 is arranged at an angle 35 being adjustable at the side wall 4 according to double arrow 37 by a fixing screw 36 and an elongated hole (not illustrated).

Many variations and modifications may be made to the preferred embodiments of the invention without departing substantially from the spirit and principles of the invention. All such modifications and variations are intended to be included herein within the scope of the present invention, as defined by the following claims.

We claim:

1. A method of unmatching and making available folded cardboard boxes, said method comprising the steps of:

arranging a stack of folded cardboard boxes in a magazine, the folded cardboard boxes each having a plane of main extension and two parallel side edges, the folded cardboard boxes arriving in the stack in a direction substantially perpendicular to the plane of main extension, the two parallel side edges of the first folded cardboard box in the stack being contacted and supported by a first and by a second stop;

conveying the first folded cardboard box in the direction toward the second stop within the plane of main extension until the first folded cardboard box enters an opening being located in the region of the second stop;

freeing the first folded cardboard box from contact to the first stop to be exclusively supported by the opening and by the second stop;

bending the first folded cardboard box in a direction away from the stack due to gravity of the folded cardboard boxes; and removing the first folded cardboard box from the stack.

2. The method of claim 1, wherein the step of removing the first folded cardboard box includes the substep of rotating the first folded cardboard box in a direction opposite to the transverse conveying direction of the first folded cardboard box toward the second stop.

3. The method of claim 1, wherein the first stop is moved back and forth to move the first folded cardboard box in the transverse direction toward the second stop, and to free one side edge of the first folded cardboard box from contact to the first stop during the backward movement.

4. An apparatus for unmatching and making available folded cardboard boxes, comprising:

a magazine being designed and arranged to hold a stack of folded cardboard boxes, the folded cardboard boxes each having a plane of main extension and two parallel side edges, the folded cardboard boxes arriving in the stack in a direction substantially perpendicular to the plane of main extension;

a movable first stop including a step;

a stationary second stop;

an opening being arranged in the region of said second stop;

said first and second stop being designed and arranged to contact and support the two parallel side edges of the first folded cardboard box in the stack in a fist position;

said first stop with its step being designed as a transverse conveying device for exclusively conveying the first folded cardboard box from said first stop in the direction toward said second stop within the plane of main extension until the first folded cardboard enters said opening being arranged in the region of said second stop and it gets free from contact to said first stop to be exclusively supported by the opening and said second stop, the first folded cardboard box bending in a direction away from the stack due to gravity of the folded cardboard boxes; and an apparatus for removing the first folded cardboard box from the stack.

5. The apparatus of claim 4, wherein said first stop is connected to a lifting drive to be moved back and forth.

6. The apparatus of claim 4, wherein said step includes an undercut.

7. The apparatus of claim 4, wherein said first stop and said second stop are each designed and arranged to be adjustable with respect to one another.

8. The apparatus of claim 4, wherein said first stop and said second stop are each designed and arranged to be adjustable with respect to one another in response to the width of the folded cardboard boxes.

9. The apparatus of claim 5, wherein the depth of said opening of said second stop corresponds to the stroke of said lifting drive.

10. The apparatus of claim 5, wherein the depth of said opening is greater than the stroke of said lifting drive.

* * * * *